US005722497A

United States Patent [19]

Gum et al.

[11] Patent Number: 5,722,497

[45] Date of Patent: Mar. 3, 1998

[54] ROLLER CONE GAGE SURFACE CUTTING ELEMENTS WITH MULTIPLE ULTRA HARD CUTTING SURFACES

[75] Inventors: Robert C. Gum, Oklahoma City, Okla.; William D. Vanderford, Irving; Thomas M. Dennis, Houston, both of Tex.

[73] Assignee: Dresser Industries, Inc., Dallas, Tex.

[21] Appl. No.: 628,534

[22] Filed: Mar. 21, 1996

[51] Int. Cl.[6] ..... E21B 10/16; E21B 10/50

[52] U.S. Cl. ..... 175/374; 175/426

[58] Field of Search ..... 175/331, 374, 175/426, 428, 434

[56] References Cited

U.S. PATENT DOCUMENTS

| | | |
|---|---|---|
| Re. 32,036 | 11/1985 | Dennis . |
| 1,306,674 | 6/1919 | Esseling . |
| 1,996,322 | 4/1935 | Carlson . |
| 2,014,806 | 9/1935 | Howard et al. . |
| 2,027,700 | 1/1936 | Rogatz . |
| 2,081,195 | 5/1937 | Catland et al. . |
| 2,103,611 | 12/1937 | Catland et al. . |
| 2,117,481 | 5/1938 | Howard . |
| 2,121,202 | 6/1938 | Killgore . |
| 2,123,453 | 7/1938 | Catland et al. . |
| 2,358,642 | 9/1944 | Kammerer . |
| 2,412,915 | 12/1946 | Sewell . |
| 2,470,695 | 5/1949 | Goodwin et al. . |
| 2,514,586 | 7/1950 | Natland et al. . |
| 2,661,931 | 12/1953 | Swart . |
| 2,667,334 | 1/1954 | Ortloff . |
| 2,774,571 | 12/1956 | Morlan . |
| 2,804,282 | 8/1957 | Spengler, Jr. . |
| 2,893,696 | 7/1959 | McGuire . |
| 2,901,223 | 8/1959 | Scott . |
| 3,075,592 | 1/1963 | Overly et al. . |
| 3,091,300 | 5/1963 | Hammer ..... 175/333 |

(List continued on next page.)

FOREIGN PATENT DOCUMENTS

| | | |
|---|---|---|
| 2019921 | 3/1979 | United Kingdom . |
| 2138864 | 10/1984 | United Kingdom ..... 175/374 |

OTHER PUBLICATIONS

"Kor King" Diamant Boart Stratabit, 1988.

"readily available fluid. . ." (no date).

"PDC Bits Matrix", Security DBS, pp. 32–39 (no date).

U.S. Patent Application No. 08/368,305 filed Jan. 3, 1995 entitled *Roller Cone Rock Bit Having Improved Cutter Cone Gauge Surface Compact and Method of Construction.*

U.S. Patent Application No. 08/589,815 filed Jan. 22, 1996 entitled *Rotary Cone Drill Bit with Contoured Inserts and Compacts.*

Correspondence to Customers,MEGAdiamond, *Megadiamond Announces A Uniques Service*, Oct. 6, 1981 (4pgs.).

International Search report for Application No. PCT/US97/03812 dated May 14, 1997.

*Primary Examiner*—David J. Bagnell

*Attorney, Agent, or Firm*—Baker & Botts, L.L.P.

[57] ABSTRACT

A gage surface cutting element (22, 30, 50, 70, 100, 120) for a cutter (20) in a roller cone drill bit (10) has a generally cylindrical body (32, 52, 72, 102, 122) formed of a hard and wear-resistant material. The cutting end (34, 54, 74, 104, 124) of the cutting element (22, 30, 50, 70, 100, 120) has a generally conical cutting surface (38, 58, 78, 108, 128) substantially perpendicular to a longitudinal axis of the cylindrical body (32, 52, 72, 102, 122). A plurality of generally parallel shallow and elongated grooves (40–42, 60–63, 80–82, 110–112, 130–132) are formed in the conical cutting surface (38, 58, 78, 108, 128), and a plurality of elongated strips of an ultra hard material (44–46, 64–67, 84–86, 114–116, 134–136) is disposed in the grooves. The result is a conical cutting surface (38, 58, 78, 108, 128) that has alternating hard and ultra hard cutting surfaces that can be oriented at 0°, 90°, or any angle in between with respect to the rotational direction of the cutter cone (20).

77 Claims, 4 Drawing Sheets

U.S. PATENT DOCUMENTS

| | | | |
|---|---|---|---|
| 3,095,053 | 6/1963 | Pistole et al. . | |
| 3,100,544 | 8/1963 | Overly et al. | 175/333 |
| 3,126,067 | 3/1964 | Schumacher, Jr. | 175/374 |
| 3,134,447 | 5/1964 | McElya et al. | 175/332 |
| 3,137,355 | 6/1964 | Schumacher, Jr. | 175/374 |
| 3,174,564 | 3/1965 | Morlan . | |
| 3,250,337 | 5/1966 | Demo | 175/343 |
| 3,311,181 | 3/1967 | Fowler . | |
| 3,389,761 | 6/1968 | Ott | 175/374 |
| 3,461,983 | 8/1969 | Hudson et al. | 175/375 |
| 3,739,864 | 6/1973 | Cason | 175/228 |
| 3,858,671 | 1/1975 | Kita et al. . | |
| 3,922,038 | 11/1975 | Seales . | |
| 3,948,330 | 4/1976 | Langford, Jr. | 175/339 |
| 3,952,815 | 4/1976 | Dysart | 175/374 |
| 4,006,788 | 2/1977 | Garner | 175/330 |
| 4,014,395 | 3/1977 | Pearson . | |
| 4,056,153 | 11/1977 | Migleirini | 175/376 |
| 4,058,177 | 11/1977 | Langford, Jr. et al. | 175/374 |
| 4,092,054 | 5/1978 | Dye . | |
| 4,098,358 | 7/1978 | Klima | 175/65 |
| 4,102,419 | 7/1978 | Klima | 175/371 |
| 4,109,737 | 8/1978 | Bovenkerk . | |
| 4,140,189 | 2/1979 | Garner . | |
| 4,148,368 | 4/1979 | Evans . | |
| 4,156,329 | 5/1979 | Daniels et al. . | |
| 4,158,394 | 6/1979 | Ernst et al. | 175/228 |
| 4,176,848 | 12/1979 | Lafuze | 277/92 |
| 4,179,003 | 12/1979 | Cooper et al. | 175/371 |
| 4,183,416 | 1/1980 | Walters | 175/229 |
| 4,183,417 | 1/1980 | Levefelt | 175/339 |
| 4,199,856 | 4/1980 | Farrow et al. . | |
| 4,203,496 | 5/1980 | Baker, III et al. . | |
| 4,225,144 | 9/1980 | Zitz et al. | 277/12 |
| 4,249,622 | 2/1981 | Dysart | 175/277 |
| 4,253,710 | 3/1981 | Goodman . | |
| 4,256,193 | 3/1981 | Kunkel et al. | 175/371 |
| 4,258,806 | 3/1981 | Kunkel et al. | 175/370 |
| 4,260,203 | 4/1981 | Garner . | |
| 4,265,324 | 5/1981 | Morris et al. . | |
| 4,272,134 | 6/1981 | Levefelt . | |
| 4,279,450 | 7/1981 | Morris . | |
| 4,284,310 | 8/1981 | Olschewski et al. . | |
| 4,285,409 | 8/1981 | Allen | 175/336 |
| 4,287,957 | 9/1981 | Evans | 175/17 |
| 4,298,079 | 11/1981 | Norlander et al. | 175/339 |
| 4,301,877 | 11/1981 | Cloud | 175/340 |
| 4,343,371 | 8/1982 | Baker, III et al. . | |
| 4,359,335 | 11/1982 | Garner . | |
| 4,375,242 | 3/1983 | Galle | 175/228 |
| 4,386,668 | 6/1983 | Parish | 175/228 |
| 4,386,669 | 6/1983 | Evans | 175/269 |
| 4,388,984 | 6/1983 | Oelke . | |
| 4,421,184 | 12/1983 | Mullins | 175/337 |
| 4,442,909 | 4/1984 | Radtke | 175/329 |
| 4,444,281 | 4/1984 | Schumacher, Jr. et al. | 175/336 |
| 4,453,836 | 6/1984 | Klima . | |
| 4,512,426 | 4/1985 | Bidegaray . | |
| 4,515,228 | 5/1985 | Dolezal et al. | 175/313 |
| 4,527,644 | 7/1985 | Allan | 175/333 |
| 4,533,003 | 8/1985 | Bailey et al. | 175/269 |
| 4,540,596 | 9/1985 | Nimmagadda | 427/37 |
| 4,545,441 | 10/1985 | Williamson . | |
| 4,552,232 | 11/1985 | Frear | 175/337 |
| 4,592,433 | 6/1986 | Dennis . | |
| 4,593,775 | 6/1986 | Chaney et al. | 175/228 |
| 4,595,067 | 6/1986 | Drake | 175/331 |
| 4,597,455 | 7/1986 | Walters et al. | 175/228 |
| 4,602,691 | 7/1986 | Weaver . | |
| 4,608,226 | 8/1986 | Lauvinerie et al. . | |
| 4,610,319 | 9/1986 | Kalsi | 175/371 |
| 4,610,452 | 9/1986 | DiRienz | 277/83 |
| 4,624,329 | 11/1986 | Evans et al. | 175/374 |
| 4,629,338 | 12/1986 | Ippolito . | |
| 4,688,651 | 8/1987 | Dysart | 175/371 |
| 4,690,228 | 9/1987 | Voelz et al. | 175/24 |
| 4,694,918 | 9/1987 | Hall . | |
| 4,705,124 | 11/1987 | Abrahamson . | |
| 4,722,405 | 2/1988 | Langford, Jr. | 175/374 |
| 4,724,913 | 2/1988 | Morris . | |
| 4,729,440 | 3/1988 | Hall | 175/107 |
| 4,729,603 | 3/1988 | Elfgen | 299/111 |
| 4,738,322 | 4/1988 | Hall et al. . | |
| 4,744,427 | 5/1988 | Grappendorf . | |
| 4,784,023 | 11/1988 | Dennis . | |
| 4,802,539 | 2/1989 | Hall et al. . | |
| 4,813,502 | 3/1989 | Dysart | 175/337 |
| 4,832,139 | 5/1989 | Minikus et al. | 175/374 |
| 4,865,136 | 9/1989 | White | 175/227 |
| 4,926,950 | 5/1990 | Zijsling . | |
| 4,928,777 | 5/1990 | Shirley-Fisher . | |
| 4,940,099 | 7/1990 | Deane et al. | 175/374 |
| 4,942,930 | 7/1990 | Millsapps, Jr. | 175/228 |
| 4,967,854 | 11/1990 | Barnetche-Gonzales | 175/353 |
| 4,976,324 | 12/1990 | Tibbitts . | |
| 4,981,182 | 1/1991 | Dysart | 175/71 |
| 4,984,643 | 1/1991 | Isbell et al. | 175/341 |
| 4,997,049 | 3/1991 | Tank et al. . | |
| 5,025,874 | 6/1991 | Barr et al. . | |
| 5,027,911 | 7/1991 | Dysart | 175/57 |
| 5,080,183 | 1/1992 | Schumacher et al. | 175/371 |
| 5,131,480 | 7/1992 | Lockstedt et al. | 175/374 |
| 5,145,016 | 9/1992 | Estes | 175/331 |
| 5,154,245 | 10/1992 | Waldenstrom et al. | 175/420.2 |
| 5,176,212 | 1/1993 | Tandberg | 175/333 |
| 5,287,936 | 2/1994 | Grimes et al. | 175/331 |
| 5,332,051 | 7/1994 | Knowlton | 175/430 |
| 5,341,890 | 8/1994 | Cawthorne et al. | 175/374 |
| 5,346,026 | 9/1994 | Pessier et al. | 175/229 |
| 5,351,768 | 10/1994 | Scott et al. | 175/374 |
| 5,351,770 | 10/1994 | Cawthorne et al. | 175/374 |
| 5,370,717 | 12/1994 | Lloyd et al. | 51/295 |
| 5,379,854 | 1/1995 | Dennis | 175/434 |
| 5,407,022 | 4/1995 | Scott et al. | 175/331 |
| 5,499,688 | 3/1996 | Dennis | 175/426 |

ROLLER CONE GAGE SURFACE CUTTING ELEMENTS WITH MULTIPLE ULTRA HARD CUTTING SURFACES

TECHNICAL FIELD OF THE INVENTION

This invention is related in general to the field of down hole drill bits. More particularly, the invention is related to cutting elements with multiple ultra hard cutting surfaces for the gage surface of a roller cone drill bit.

BACKGROUND OF THE INVENTION

In the field of exploration and production of oil and gas, one type of drill bit or rock bit used for drilling earth boreholes is commonly known as a roller cone drill bit. The typical roller cone drill bit employs a multiplicity of rolling cone cutters rotatably mounted to extend downwardly and inwardly with respect to the central axis of the drill bit. The rolling cone cutters may have milled teeth or cutter inserts disposed on each cutter in predefined patterns.

It has been recognized that it is important in the drilling operation for the drill bit to maintain a consistent borehole diameter. As the drill bit cuts into a rock formation to form a borehole, one portion of each cone cutter, typically called the gage surface, contacts the sidewall of the borehole. Some roller cone drill bits have been provided wear-resistant and/or ultra hard cutter inserts in the gage surface to cut the sidewall and maintain the diameter of the borehole. The wear-resistant inserts are generally susceptible to heat cracking and spalling during use, and ultra hard cutter inserts are generally prone to frictional heat and chipping damage due to the intense friction between the rock formation and insert. It has also been recognized that flat-tipped inserts may be more prone to damage associated with friction heat, and chisel-tipped inserts may be more prone to breakage.

SUMMARY OF THE INVENTION

Accordingly, there is a need for a gage surface cutting element that produces a reduced amount of frictional heat, is less prone to chipping damage, while maintaining an effective cutting surface.

In accordance with the present invention, a cutting element for the gage surface of a cone cutter is provided which eliminates or substantially reduces the disadvantages associated with prior cutter inserts.

In one aspect of the invention, a gage surface cutting element for a cutter in a roller cone drill bit has a generally cylindrical body formed of a hard and wear-resistant material. The cutting end of the cutting element has a generally conical cutting surface substantially perpendicular to a longitudinal axis of the cylindrical body. The cutting end may additionally include a sloped surface connecting the conical cutting surface and the cylindrical body. The conical cutting surface has an obtuse angle $\alpha$ that may vary between 160° and 180°. A plurality of shallow grooves is formed in the conical cutting surface, and a plurality of strips of an ultra hard material is disposed in the grooves. The number of grooves and inserts or inlays may range anywhere from one or more, depending on the diameter of the cutting element and the rock formation to be drilled. The result is a conical cutting surface with alternating hard and ultra hard cutting surfaces that can be oriented at 0°, 90°, or any angle in between with respect to the rotational direction of the cutter cone.

In another aspect of the invention, the shallow grooves may be radiused in the conical cutting surface, squared-off in the conical cutting surface, dovetailed in the conical cutting surface, or open-ended toward the conical cutting surface.

BRIEF DESCRIPTION OF THE DRAWINGS

For a better understanding of the present invention, reference may be made to the accompanying drawings, in which.

DETAILED DESCRIPTION OF THE INVENTION

Figure 1:
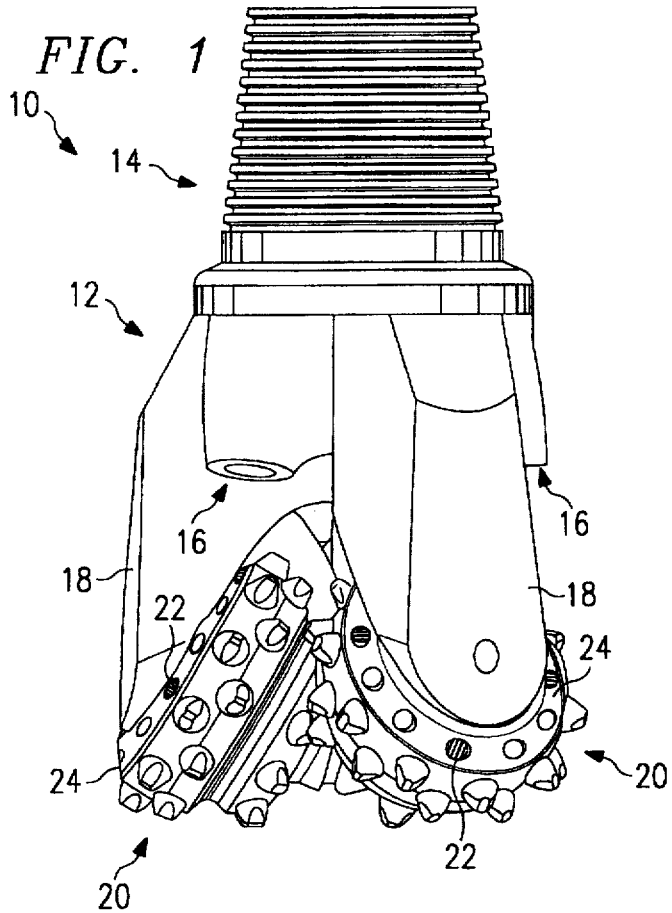
FIG. 1 is an isometric view of a roller cone drill bit having cutting elements constructed according to the present invention installed in the gage surface of the conical cutters.

The preferred embodiments of the present invention are illustrated in FIGS. 1–19, like reference numerals being used to refer to like and corresponding parts of the various drawings.

For purposes of illustration, the present invention is shown embodied in a roller cone drill bit 10 used in drilling a borehole in the earth, as shown in FIG. 1. Roller cone drill bit 10 may also be referred to as a "rotary drill bit" or "rock bit." Roller cone drill bit 10 preferably includes a bit body 12 with an upper threaded portion or pin 14 adapted for attaching to the lower end of a drill string (not shown). Threaded portion 14 and the corresponding threaded connection of the drill string allow for the rotation of drill bit 10 in response to the rotation of the drill string at the well surface. Bit body 12 includes an inner passage (not shown) that permits cool drilling mud or like material to pass downward from the drill string. The drilling mud exits through nozzles 16 (two are shown), flows downward to the bottom of the borehole and then passes upward in the annulus between the wall of the borehole and the drill string, carrying drilling debris and rock chips therewith.

In the tri-cone roller cone drill bit 10, three substantially identical arms 18 (two are shown) depend from bit body 12. Each arm 18 rotatably supports a conical cutter assembly 20, and each conical cutter assembly 20 has a plurality of cutter inserts or milled teeth arranged in a predetermined manner thereon. The present invention is directed to cutter inserts or cutting elements 22 disposed in a gage surface 24 located on cutter assembly 20. Cutter inserts 22 make up a surf row of the cutter assembly 20 and is defined as the portion of the cutter assembly 20 which contacts the outermost periphery or sidewall of the borehole (not shown) as drill bit 10 is rotatably cutting the borehole. The surf row is also commonly called a gage row in the industry and will be referred to as such hereinafter.

Figure 2:
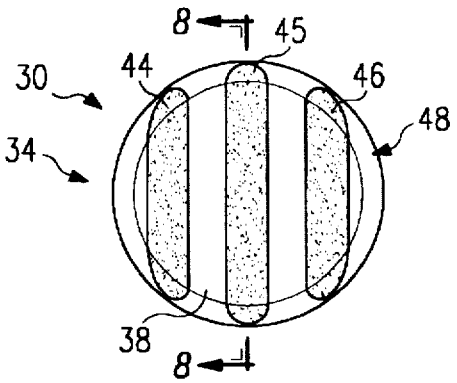
FIG. 2 is a top view of a conical cutting surface of a cutting element constructed according to the present invention.
Figure 3:
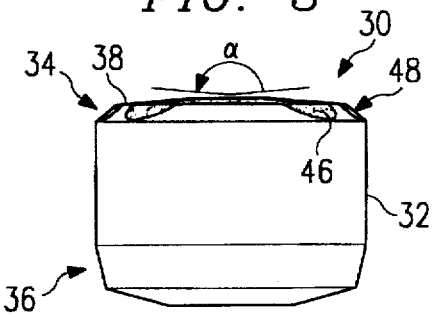
FIG. 3 is a side view of the cutting element.
Figure 4:
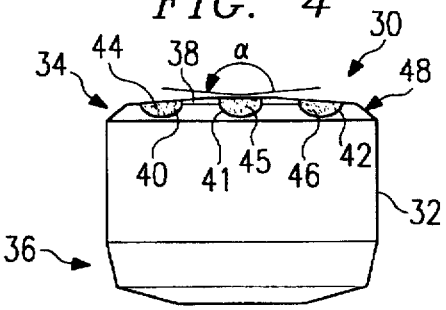
FIG. 4 is another side view of the cutting element.

Referring to FIGS. 2–4, a cutter insert 30 constructed according to the teachings of the present invention is shown. Cutter insert 30 includes a generally cylindrical body 32 or substrate constructed from a hard and wear-resistant material such as cemented tungsten carbide. Cutter insert body 32 has a cutting end 34 and a base 36 which is press fit into sockets formed in gage surface 24 of conical cutter assembly 20. Cutting end 34 defines a generally conical cutting surface 38, which extends slightly above the gage surface 24 to contact the borehole. Conical cutting surface 38 has an obtuse angle that may vary between 160° and 180°.

Formed in conical cutting surface 38 of cutting element 30 is a plurality of shallow grooves 40–42 extending generally parallel with one another. Inlaid into these grooves 40–42 are elongated strips or inserts 44–46 made from an ultra hard and abrasion-resistant material, such as diamond, polycrystalline diamond, thermally stable polycrystalline diamond (TSP), cubic boron nitride or other non-diamond material that is ultra hard and abrasion-resistant. Elongated inserts 44–46 are manufactured and shaped to conform to grooves 40–42 to ensure a secure fit. Elongated ultra hard inserts 44–46 may be secured in grooves 40–42 by sintering, brazing, interference fit, or other like methods. Constructed in this manner, conical cutting surface 38 is defined by both hard and ultra hard materials. Cutting end 34 may additionally include a sloped surface 48 connecting conical cutting surface 38 and cylindrical body 32. The sloped surface 48 may be chamfered, radiused, beveled, or similarly inclined.

Figure 5:
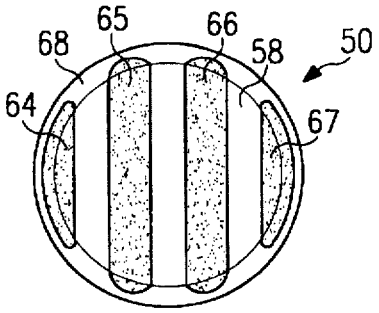
FIG. 5 is a top view of another embodiment of a conical cutting surface of a cutting element constructed according to the present invention.
Figure 6:
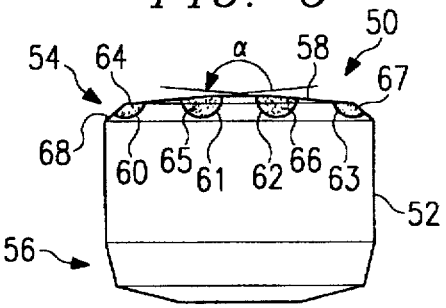
FIG. 6 is a side view of the cutting element shown in FIG. 5.
Figure 7:
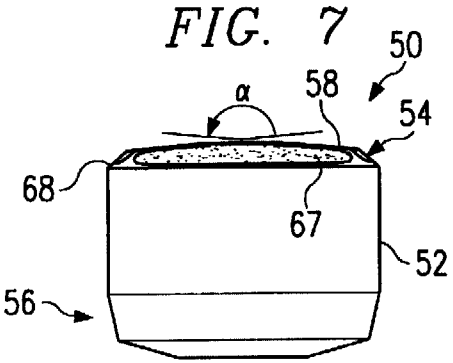
FIG. 7 is another side view of the cutting element.

Referring to FIGS. 5–7, another embodiment of a cutter insert 50 is shown. Cutter insert 50 includes a generally cylindrical body 52 also constructed from a hard and wear-resistant material such as cemented tungsten carbide. Cutter insert body 52 includes a cutting end 54 and a base 56. Cutting end 54 defines a generally conical cutting surface 58, which extends slightly above the gage surface 24 when mounted therein. Conical cutting surface 58 has an obtuse angle α between 160° and 180°.

Formed in conical cutting surface 58 of cutting element 50 is a plurality of shallow grooves 60–63 extending generally parallel with one another. Filling in these grooves 60–63 are elongated strips or inserts 64–67 made from an ultra hard and abrasion-resistant material, such as diamond, polycrystalline diamond, thermally stable polycrystalline diamond (TSP), cubic boron nitride or other non-diamond material that is ultra hard and abrasion-resistant. Elongated inserts 64–67 are manufactured and shaped to conform to grooves 60–63 to ensure a secure fit. Elongated ultra hard inserts 64–67 may be secured in grooves 60–63 by sintering, brazing, interference fit, or other methods. Cutting end 54 may also include a sloped surface 68 connecting conical cutting surface 58 and cylindrical body 52. The sloped surface 68 may be chamfered, radiused, beveled, or similarly inclined.

Figure 9:
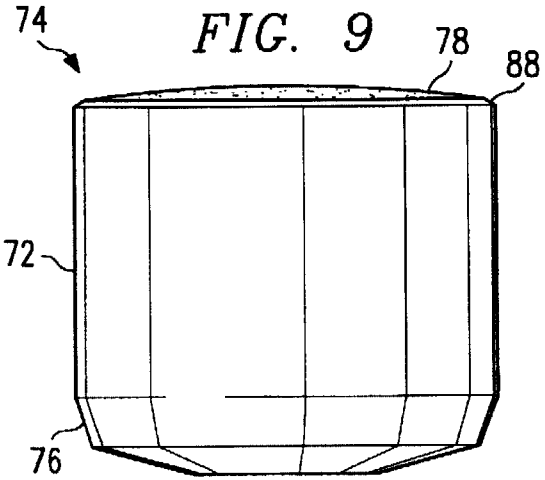
FIG. 9 is a side view of the cutting element shown in FIG. 8.
Figure 8:
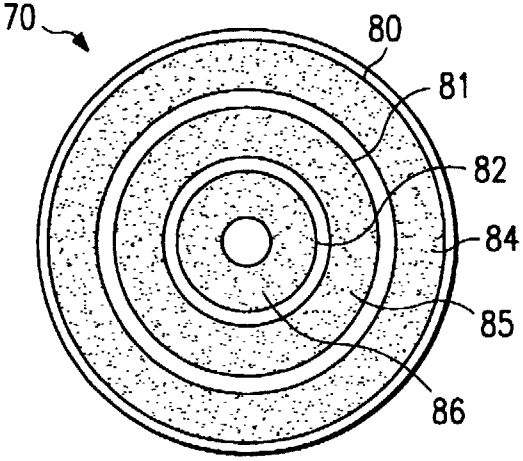
FIG. 8 is a top view of another embodiment of a conical cutting surface of a cutting element constructed according to the present invention.

Referring to FIGS. 8–9, another embodiment of a cutter insert 70 is shown. Cutter insert 70 includes a generally cylindrical body 72 constructed from a hard and wear-resistant material such as cemented tungsten carbide. Cutter insert body 72 includes a cutting end 74 and a base 76. Cutting end 74 defines a generally conical cutting surface 78, which extends slightly above the gage surface 24 when mounted therein. Conical cutting surface 78 has an obtuse angle α between 160° and 180°.

Formed in conical cutting surface 78 of cutting element 70 is a plurality of circular shallow grooves 80–82 extending generally concentric with one another. Filling in these grooves 80–82 are circular strips or inserts 84–86 made from an ultra hard and abrasion-resistant material, such as diamond, polycrystalline diamond, thermally stable polycrystalline diamond (TSP), cubic boron nitride or other non-diamond material that is ultra hard and abrasion-resistant. Elongated inserts 84–86 are manufactured and shaped to conform to grooves 80–82 to ensure a secure fit. Elongated ultra hard inserts 84–86 may be secured in grooves 80–82 by sintering, brazing, interference fit, or other methods. Cutting end 74 may also include a sloped surface 88 connecting conical cutting surface 78 and cylindrical body 72. The sloped surface 88 may be chamfered, radiused, beveled, or similarly inclined.

Figure 11:
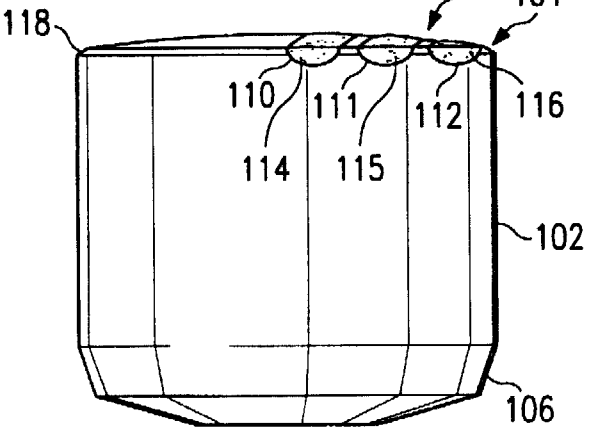
FIG. 11 is a side view of the cutting element shown in FIG. 10.
Figure 10:
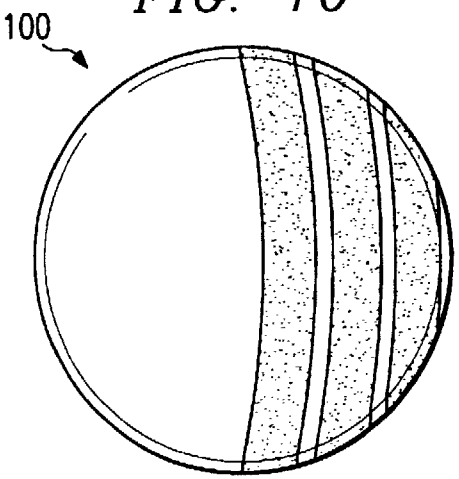
FIG. 10 is a top view of another embodiment of a conical cutting surface of a cutting element constructed according to the present invention.

Referring to FIGS. 10–11, another embodiment of a cutter insert 100 is shown. Cutter insert 100 includes a generally cylindrical body 102 constructed from a hard and wear-resistant material such as cemented tungsten carbide. Cutter insert body 102 includes a cutting end 104 and a base 106. Cutting end 104 defines a generally conical cutting surface 108, which extends slightly above the gage surface 24 when mounted therein. Conical cutting surface 108 has an obtuse angle α between 160° and 180°.

Formed in conical cutting surface 108 of cutting element 100 is a plurality of curved shallow grooves 110–112 extending generally in equal spaced relation with one another. Filling in these grooves 110–112 are elongated curved strips or inserts 114–116 made from an ultra hard and abrasion-resistant material, such as diamond, polycrystalline diamond, thermally stable polycrystalline diamond (TSP), cubic boron nitride or other non-diamond material that is ultra hard and abrasion-resistant. Elongated inserts 114–116 are manufactured and shaped to conform to grooves 110–112 to ensure a secure fit. Elongated ultra hard inserts 114–116 may be secured in grooves 110–112 by sintering, brazing, interference fit, or other methods. Cutting end 104 may also include a sloped surface 118 connecting conical cutting surface 108 and cylindrical body 102. The sloped surface 118 may be chamfered, radiused, beveled, or similarly inclined.

Figure 12:
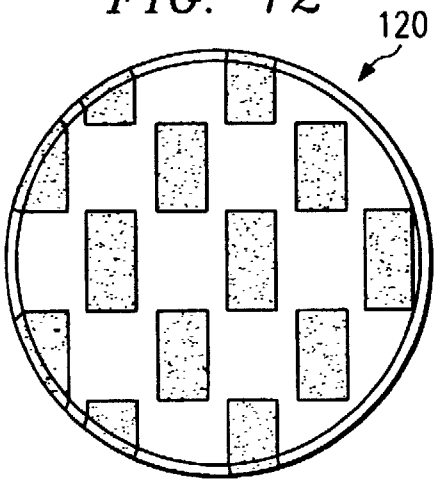
FIG. 12 is a top view of another embodiment of a conical cutting surface of a cutting element constructed according to the present invention.
Figure 13:
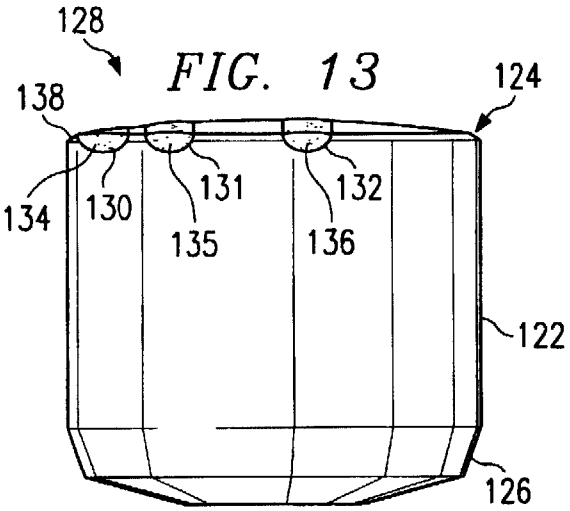
FIG. 13 is a side view of the cutting element shown in FIG. 12.

Referring to FIGS. 12–13, another embodiment of a cutter insert 120 is shown. Cutter insert 120 includes a generally cylindrical body 122 constructed from a hard and wear-resistant material such as cemented tungsten carbide. Cutter insert body 122 includes a cutting end 124 and a base 126. Cutting end 124 defines a generally conical cutting surface 128, which extends slightly above the gage surface 24 when mounted therein. Conical cutting surface 128 has an obtuse angle $\alpha$ between 160° and 180°.

Formed in conical cutting surface 128 of cutting element 120 is a plurality of rectangular shallow grooves 130–132 extending generally parallel with one another in a staggered pattern. Filling in these grooves 130–132 are rectangular strips or inserts 134–136 made from an ultra hard and abrasion-resistant material, such as diamond, polycrystalline diamond, thermally stable polycrystalline diamond (TSP), cubic boron nitride or other non-diamond material that is ultra hard and abrasion-resistant. Rectangular inserts 134–136 are manufactured and shaped to conform to grooves 130–132 to ensure a secure fit. Rectangular ultra hard inserts 134–136 may be secured in grooves 130–132 by sintering, brazing, interference fit, or other methods. Cutting end 124 may also include a sloped surface 138 connecting conical cutting surface 128 and cylindrical body 122. The sloped surface 138 may be chamfered, radiused, beveled, or similarly inclined.

Figure 14:
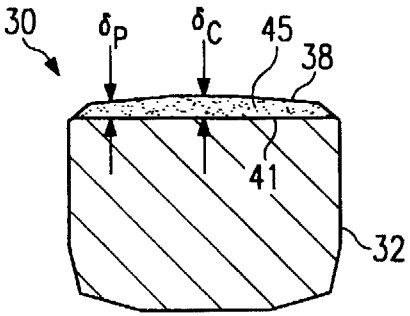
FIG. 14 is a cross-sectional view of the cutting element shown in FIG. 2.

Referring now to FIG. 14, a cross-section of a cutting element is shown. Although FIG. 14 particularly shows cutting element 30 of FIG. 2, it is equally applicable to cutting element 50 of FIG. 5, cutting element 70 of FIG. 8, cutting element 100 of FIG. 10, and cutting element 120 of FIG. 12.

In FIG. 14, the thickness or depth of ultra hard material 45 near the center of insert 30, $\delta_C$, and near the periphery, $\delta_P$, are specifically shown. It is contemplated that the thickness of ultra hard material 45 and thus the depth of shallow groove 41 need not be the same and may vary gradually. Therefore, $\delta_C$ may be greater or less than $\delta_P$ if desired depending on the rock formation and application. In particular, $\delta_P$ may be greater than $\delta_C$ because the edges experience more friction and more wearing than the center of the cutting surface. Note that the variation in ultra hard material thickness may be present in all elongated inserts in a cutting element or it may be present in selected inserts.

Figure 15:
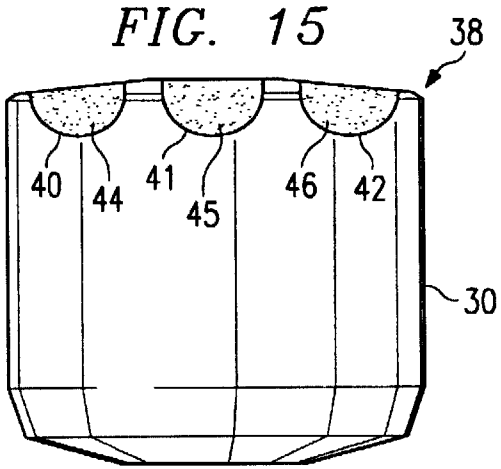
FIG. 15 is a side view of an embodiment of a groove configuration according to the present invention.

Referring now to FIGS. 15–18, the configuration of the groove may be varied to improve endurance of the cutter element. FIG. 15 shows an embodiment of a groove configuration for cutter element 30. Although FIG. 15 particularly shows cutting element 30 of FIG. 2, it is equally applicable to cutting element 50 of FIG. 5, cutting element 70 of FIG. 8, cutting element 100 of FIG. 10, and cutting element 120 of FIG. 12.

As shown by FIG. 15, grooves 40–42 are radiused in conical cutting surface 38 of cutting element 30. Elongated inserts 44–46 are manufactured and shaped to conform to the radiused grooves 40–42. Accordingly, the bulk of the ultra hard and abrasion-resistant material forming inserts 44–46 is provided at or near the conical cutting surface 38. As a result, the cutting element 30 has an increased cutting ability at the beginning of its life that exponentially decreases with wear to the element 30.

Figure 16:
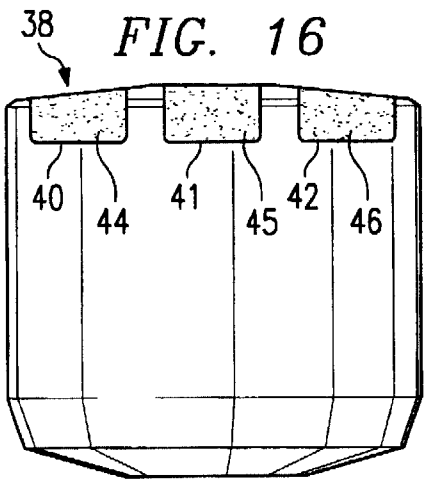
FIG. 16 is a side view of another embodiment of a groove configuration according to the present invention.

Referring now to FIG. 16, another embodiment of a groove configuration for cutter element 30 is shown. Although FIG. 16 particularly shows cutting element 30 of FIG. 2, it is equally applicable to cutting element 50 of FIG. 5, cutting element 70 of FIG. 8, cutting element 100 of FIG. 10, and cutting element 120 of FIG. 12.

As shown by FIG. 16, grooves 40–42 are squared-off in conical cutting surface 38 of cutting element 30. Elongated inserts 44–46 are manufactured and shaped to conform to the rectangular grooves 40–42. Accordingly, the ultra hard and abrasion-resistant material forming inserts 44–46 is evenly distributed throughout the inserts. As a result, the cutting element 30 has a uniform cutting ability over its life.

Figure 17:
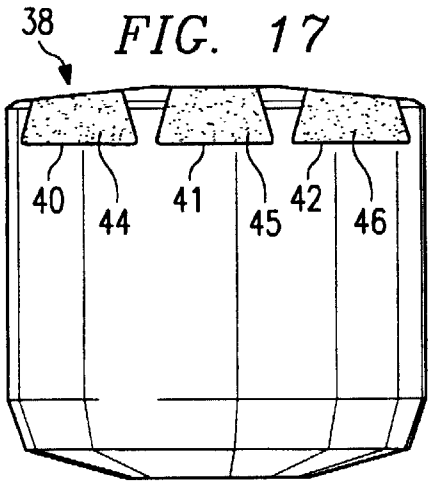
FIG. 17 is a side view of another embodiment of a groove configuration according to the present invention.

Referring now to FIG. 17, another embodiment of a groove configuration for cutter element 30 is shown. Although FIG. 17 particularly shows cutting element 30 of FIG. 2, it is equally applicable to cutting element 50 of FIG. 5, cutting element 70 of FIG. 8, cutting element 100 of FIG. 10, and cutting element 120 of FIG. 12.

As shown by FIG. 17, grooves 40–42 are dovetailed in conical cutting surface 38 of cutting element 30. Elongated inserts 44–46 are manufactured and shaped to conform to the dovetailed grooves 40–42. Accordingly, the bulk of the ultra hard and abrasion-resistant material forming inserts 44–46 is provided below the conical cutting surface 38. As a result, the cutting element 30 has a decreased cutting ability at the beginning of its life that exponentially increases with wear to the element 30. Moreover, the dovetailed grooves 40–42 provide increased retention by the cutting element for the inserts 44–46. As a result, the inserts tend to wear down past the point where they would break off in other configurations.

Figure 18:
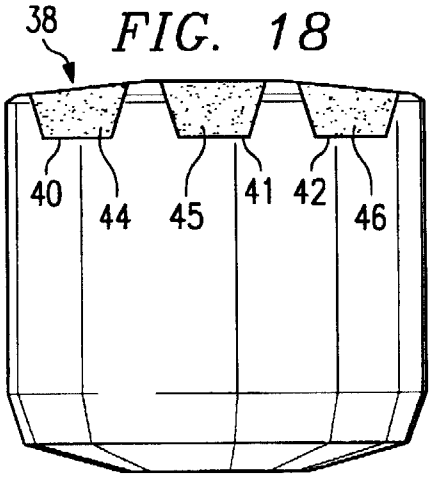
FIG. 18 is a side view of another embodiment of a groove configuration according to the present invention.

Referring now to FIG. 18, another embodiment of a groove configuration for cutter element 30 is shown. Although FIG. 18 particularly shows cutting element 30 of FIG. 2, it is equally applicable to cutting element 50 of FIG. 5, cutting element 70 of FIG. 8, cutting element 100 of FIG. 10, and cutting element 120 of FIG. 12.

As shown by FIG. 18, grooves 40–42 are open-ended toward the conical cutting surface 38 of cutting element 30. Elongated inserts 44–46 are manufactured and shaped to conform to the open-ended grooves 40–42. Accordingly, the bulk of the ultra hard and abrasion-resistant material forming inserts 44–46 is provided at or near the conical cutting surface 38. As a result, the cutting element 30 has an increased cutting ability at the beginning of its life that exponentially decreases with wear to the element 30.

Figure 19A:
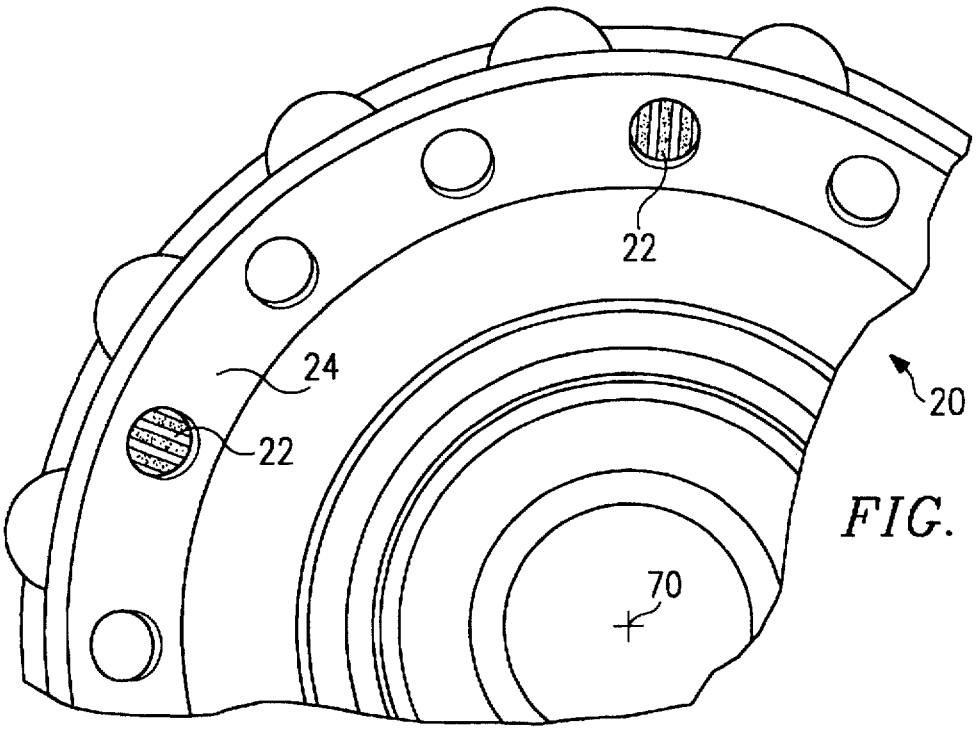
FIGS. 19A and 19B are views of the gage surface of the conical cutter to demonstrate the orientation of the cutting element with respect to the direction of rotation.
Figure 19B:
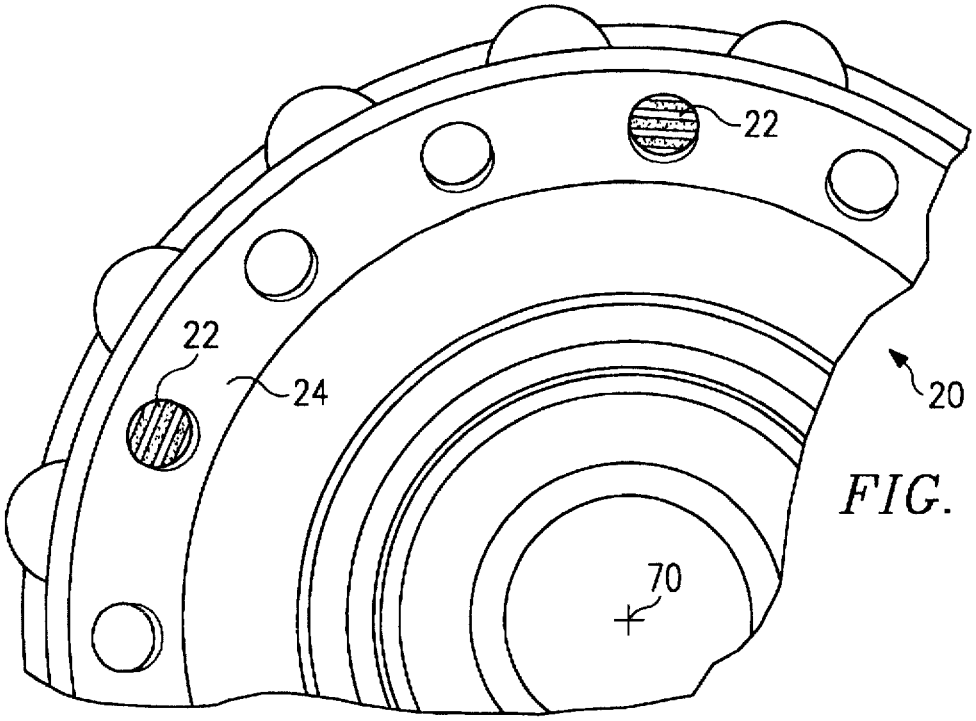

Referring to FIGS. 19A and 19B, a partial view of roller cone cutter 20 is shown as seen from the base thereof. Cutter 20 includes gage surface 24 in which a row of cutting elements is mounted, including cutting elements 22 constructed in accordance with the teachings of the present invention. Cutter 20 rotates about a center axis 70 in the direction of rotation as indicated.

In FIG. 19A, cutting elements 22 are mounted in the gage row such that the ultra hard inserts are generally perpendicular to the direction of rotation. In other words, the axis of the ultra hard inserts is at 90° to the direction of cone rotation. When mounted in this manner, a plurality of successive cutting surfaces formed by alternating hard and ultra hard materials are presented to the rock formation in the sidewall of the borehole. The hard material acts to protect the ultra hard inserts from chipping damage caused by over exposure of the ultra hard material to the sidewall of the borehole. Depending on the position of ultra hard inserts, the leading edge or cutting surface may be the hard or ultra hard material. As the leading edge wears away, the next cutting surface presents a new cutting edge and surface to continuously cut a full diameter borehole.

In FIG. 19B, the axis of ultra hard inserts in cutting elements 22 are oriented generally parallel with respect to the direction of cone rotation. In other words, the ultra hard inserts are at 0° to the direction of rotation. The resulting cutting action is rake or claw-like. The interruption of the ultra hard cutting surface by the hard cutting surface as the leading edge of the cutting surfaces is presented to the rock formation results in less friction and more efficient cutting.

It may be seen that cutting element 22 constructed according to the present invention may populate all sockets in the gage row or selected sockets therein depending on the application and rock formation.

Although the present invention and its advantages have been described in detail, it should be understood that various changes, substitutions and alterations can be made therein without departing from the spirit and scope of the invention as defined by the appended claims.

What is claimed is:

1. A gage surface cutting element for a cutter in a roller cone drill bit, comprising:

a generally cylindrical body formed of a hard and wear-resistant material and having a cutting end, said cutting end having a generally conical cutting surface substantially perpendicular to a longitudinal axis of said cylindrical body;

a plurality of shallow grooves formed in said conical cutting surface;

a plurality of strips of an ultra hard material having a shape and profile conforming to said shallow grooves, said strips defining cutting surfaces substantially in line with said conical cutting surface;

said hard and wear-resistant material and said ultra hard material defining a plurality of alternating hard and ultra hard elongated cutting surfaces and a small angle of approach with respect to a sidewall of a borehole; and wherein said conical cutting surface has an angle between 160° and 180°.

2. The gage surface cutting element, as set forth in claim 1, wherein a plurality of the cutting elements are interference fitted into sockets formed in the gage surface of the cutter, the cutting elements being oriented so that a plurality of alternating hard and ultra hard cutting surfaces are defined generally perpendicular to the direction of cutter rotation.

3. The gage surface cutting element, as set forth in claim 2, wherein said plurality of alternating hard and ultra hard cutting surfaces wear successively to continuously present a new cutting surface to cut and maintain a full diameter bore hole.

4. The gage surface cutting element, as set forth in claim 3, wherein a leading cutting surface is of the hard material.

5. The gage surface cutting element, as set forth in claim 3, wherein a leading cutting surface is of the ultra hard material.

6. The gage surface cutting element, as set forth in claim 1, wherein a plurality of the cutting elements are interference fitted into sockets formed in the gage surface of the cutter, the cutting elements being oriented so that a plurality of alternating hard and ultra hard cutting surfaces are generally defined parallel with the direction of cutter rotation.

7. The gage surface cutting element, as set forth in claim 6, wherein said plurality of alternating hard and ultra hard cutting surfaces cut and maintain a full diameter bore hole with a claw-like cutting action.

8. The gage surface cutting element, as set forth in claim 1, wherein a plurality of the cutting elements are interference fitted into sockets formed in the gage surface of the cutter, the cutting elements being oriented so that an axis of said plurality of strips of ultra hard material is oriented at an angle between 0° to 90°, inclusively, to the direction of cutter rotation.

9. The gage surface cutting element, as set forth in claim 1, wherein said shallow grooves and strips of ultra hard material extend substantially to a periphery edge of said conical cutting surface.

10. The gage surface cutting element, as set forth in claim 1, wherein at least one of said plurality of shallow grooves has varying depth along its length.

11. The gage surface cutting element, as set forth in claim 1, wherein said plurality of shallow grooves are deeper near a center of said conical cutting surface than near a periphery edge of said conical cutting surface.

12. The gage surface cutting element, as set forth in claim 1, wherein said plurality of shallow grooves are shallower near a center of said conical cutting surface than near a periphery edge of said conical cutting surface.

13. The gage surface cutting element, as set forth in claim 1, wherein said plurality of shallow grooves are elongated and generally parallel with one another.

14. The gage surface cutting element, as set forth in claim 13, wherein said plurality of shallow grooves are radiused in said conical cutting surface.

15. The gage surface cutting element as set forth in claim 13, wherein said plurality of shallow grooves are squared-off in said conical cutting surface.

16. The gage surface cutting element, as set forth in claim 13, wherein said plurality of shallow grooves are dovetailed in said conical cutting surface.

17. The gage surface cutting element, as set forth in claim 13, wherein said plurality of shallow grooves are open-ended toward said conical cutting surface.

18. The gage surface cutting element, as set forth in claim 1, wherein said plurality of shallow grooves are curved and generally in equally spaced relation with one another.

19. The gage surface cutting element, as set forth in claim 18, wherein said plurality of shallow grooves are radiused in said conical cutting surface.

20. The gage surface cutting element, as set forth in claim 18, wherein said plurality of shallow grooves are squared-off in said conical cutting surface.

21. The gage surface cutting element, as set forth in claim 18, wherein said plurality of shallow grooves are dovetailed in said conical cutting surface.

22. The gage surface cutting element, as set forth in claim 18, wherein said plurality of shallow grooves are open-ended toward said conical cutting surface.

23. The gage surface cutting element, as set forth in claim 1, wherein said plurality of shallow grooves are radiused in said conical cutting surface.

24. The gage surface cutting element, as set forth in claim 1, wherein said plurality of shallow grooves are squared-off in said conical cutting surface.

25. The gage surface cutting element, as set forth in claim 1, wherein said plurality of shallow grooves are dovetailed in said conical cutting surface.

26. The gage surface cutting element, as set forth in claim 1, wherein said plurality of shallow grooves are open-ended toward said conical cutting surface.

27. The gage surface cutting element, as set forth in claim 1, wherein said wear-resistant hard material is cemented tungsten carbide and said ultra hard material is polycrystalline diamond.

28. The gage surface cutting element, as set forth in claim 1, wherein the cutting element is interference fitted into a socket so that said conical cutting surface is generally above the gage surface.

29. A gage surface cutting element for a cutter in a roller cone drill bit, comprising:

a generally cylindrical body formed of a hard and wear-resistant material and having a cutting end, said cutting end having a generally conical cutting surface substantially perpendicular to a longitudinal axis of said cylindrical body;

a plurality of shallow grooves formed in said conical cutting surface;

a plurality of strips of an ultra hard material having a shape and profile conforming to said shallow grooves, said strips defining cutting surfaces substantially in line with said conical cutting surface;

said hard and wear-resistant material and said ultra hard material defining a plurality of alternating hard and ultra hard elongated cutting surfaces and a small angle of approach with respect to a sidewall of a borehole; and a sloped surface coupling said conical cutting surface and said cylindrical body.

30. A gage surface cutting element for a cutter in a roller cone drill bit, comprising:

a generally cylindrical body formed of a hard and wear-resistant material and having a cutting end, said cutting end having a generally conical cutting surface substantially perpendicular to a longitudinal axis of said cylindrical body;

a plurality of shallow grooves formed in said conical cutting surface;

a plurality of strips of an ultra hard material having a shape and profile conforming to said shallow grooves, said strips defining cutting surfaces substantially in line with said conical cutting surface;

said hard and wear-resistant material and said ultra hard material defining a plurality of alternating hard and ultra hard elongated cutting surfaces and a small angle of approach with respect to a sidewall of a borehole; and wherein said plurality of shallow grooves are circular and generally concentric with one another.

31. The gage surface cutting element, as set forth in claim 30, wherein said plurality of shallow grooves are radiused in said conical cutting surface.

32. The gage surface cutting element, as set forth in claim 30, wherein said plurality of shallow grooves are squared-off in said conical cutting surface.

33. The gage surface cutting element, as set forth in claim 30, wherein said plurality of shallow grooves are dovetailed in said conical cutting surface.

34. The gage surface cutting element, as set forth in claim 30, wherein said plurality of shallow grooves are open-ended toward said conical cutting surface.

35. A gage surface cutting element for a cutter in a roller cone drill bit, comprising:

a generally cylindrical body formed of a hard and wear-resistant material and having a cutting end, said cutting end having a generally conical cutting surface substantially perpendicular to a longitudinal axis of said cylindrical body;

a plurality of shallow grooves formed in said conical cutting surface;

a plurality of strips of an ultra hard material having a shape and profile conforming to said shallow grooves, said strips defining cutting surfaces substantially in line with said conical cutting surface;

said hard and wear-resistant material and said ultra hard material defining a plurality of alternating hard and ultra hard elongated cutting surfaces and a small angle of approach with respect to a sidewall of a borehole; and wherein said plurality of shallow grooves are generally parallel with one another and arranged in a staggered pattern.

36. The gage surface cutting element, as set forth in claim 35, wherein said plurality of shallow grooves are radiused in said conical cutting surface.

37. The gage surface cutting element, as set forth in claim 35, wherein said plurality of shallow grooves are squared-off in said conical cutting surface.

38. The gage surface cutting element, as set forth in claim 35, wherein said plurality of shallow grooves are dovetailed in said conical cutting surface.

39. The gage surface cutting element, as set forth in claim 35, wherein said plurality of shallow grooves are open-ended toward said conical cutting surface.

40. In a roller cone drill bit having a gage surface contacting a sidewall of a borehole during operations, said gage surface having at least one row of cutter inserts, at least one of said cutter inserts comprising:

a generally cylindrical substrate formed of cemented carbide and having a cutting end, said cutting end having a generally conical cutting surface substantially normal to a longitudinal axis of said cylindrical substrate;

a plurality of shallow grooves formed in said conical cutting surface;

a plurality of strips of polycrystalline diamond having a shape and profile conforming to said shallow grooves, said polycrystalline diamond strips defining cutting surfaces substantially in line with said conical cutting surface defined by said cemented carbide substrate;

said conical cutting surface defined by said cemented carbide substrate and said polycrystalline diamond strips forming a plurality of alternating hard and ultra hard elongated cutting surfaces and a small angle of approach with respect to the sidewall of the borehole; and wherein said conical cutting surface has an angle between 160° and 180°.

41. The cutter insert, as set forth in claim 40, wherein a plurality of the cutter inserts are interference fitted into sockets formed in the gage surface of the cutter, the cutter inserts being oriented so that a plurality of alternating hard and ultra hard cutting surfaces are defined generally perpendicular to the direction of cutter rotation.

42. The cutter insert, as set forth in claim 41, wherein said plurality of alternating hard and ultra hard cutting surfaces wear successively to continuously present a new cutting surface to cut and maintain a full diameter bore hole.

43. The cutter insert, as set forth in claim 42, wherein a leading cutting surface material is cemented carbide.

44. The cutter insert, as set forth in claim 42, wherein a leading cutting surface material is polycrystalline diamond.

45. The cutter insert, as set forth in claim 40, wherein a plurality of the cutter inserts are interference fitted into sockets formed in the gage surface of the cutter, the cutter inserts being oriented so that a plurality of alternating hard and ultra hard cutting surfaces are generally defined parallel with the direction of cutter rotation.

46. The cutter insert, as set forth in claim 45, wherein said plurality of alternating hard and ultra hard cutting surfaces cut and maintain a full diameter bore hole with a claw-like cutting action.

47. The cutter insert, as set forth in claim 40, wherein a plurality of the cutter inserts are interference fitted into sockets formed in the gage surface of the cutter, the cutter inserts being oriented so that an axis of said plurality of polycrystalline diamond strips is oriented at an angle between 0° to 90°, inclusively, to the direction of cutter rotation.

48. The cutter insert, as set forth in claim 40, wherein said shallow grooves and strips of polycrystalline diamond extend substantially to a periphery edge of said conical cutting surface.

49. The cutter insert, as set forth in claim 40, wherein at least one of said plurality of shallow grooves has varying depth along its length.

50. The cutter insert, as set forth in claim 40, wherein said plurality of shallow grooves are deeper near a center of said conical cutting surface than near a periphery edge of said conical cutting surface.

51. The cutter insert, as set forth in claim 40, wherein said plurality of shallow grooves are elongated and generally parallel with one another.

52. The cutter insert, as set forth in claim 51, wherein said plurality of shallow grooves are radiused in said conical cutting surface.

53. The cutter insert, as set forth in claim 51, wherein said plurality of shallow grooves are squared-off in said conical cutting surface.

54. The cutter insert, as set forth in claim 51, wherein said plurality of shallow grooves are dovetailed in said conical cutting surface.

55. The cutter insert, as set forth in claim 51, wherein said plurality of shallow grooves are open-ended toward said conical cutting surface.

56. The cutter insert, as set forth in claim 40, wherein said plurality of shallow grooves are circular and generally concentric with one another.

57. The cutter insert, as set forth in claim 56, wherein said plurality of shallow grooves are radiused in said conical cutting surface.

58. The cutter insert, as set forth in claim 56, wherein said plurality of shallow grooves are squared-off in said conical cutting surface.

59. The cutter insert, as set forth in claim 56, wherein said plurality of shallow grooves are dovetailed in said conical cutting surface.

60. The cutter insert, as set forth in claim 56, wherein said plurality of shallow grooves are open-ended toward said conical cutting surface.

61. The cutter insert, as set forth in claim 40, wherein said plurality of shallow grooves are curved and generally in equally spaced relation with one another.

62. The cutter insert, as set forth in claim 61, wherein said plurality of shallow grooves are radiused in said conical cutting surface.

63. The cutter insert, as set forth in claim 61, wherein said plurality of shallow grooves are squared-off in said conical cutting surface.

64. The cutter insert, as set forth in claim 61, wherein said plurality of shallow grooves are dovetailed in said conical cutting surface.

65. The cutter insert, as set forth in claim 61, wherein said plurality of shallow grooves are open-ended toward said conical cutting surface.

66. The cutter insert, as set forth in claim 40, wherein said plurality of shallow grooves are generally parallel with one another and arranged in a staggered pattern.

67. The cutter insert, as set forth in claim 66, wherein said plurality of shallow grooves are radiused in said conical cutting surface.

68. The cutter insert, as set forth in claim 66, wherein said plurality of shallow grooves are squared-off in said conical cutting surface.

69. The cutter insert, as set forth in claim 66, wherein said plurality of shallow grooves are dovetailed in said conical cutting surface.

70. The cutter insert, as set forth in claim 66, wherein said plurality of shallow grooves are open-ended toward said conical cutting surface.

71. The cutter insert, as set forth in claim 40, wherein said plurality of shallow grooves are radiused in said conical cutting surface.

72. The cutter insert, as set forth in claim 40, wherein said plurality of shallow grooves are squared-off in said conical cutting surface.

73. The cutter insert, as set forth in claim 40, wherein said plurality of shallow grooves are dovetailed in said conical cutting surface.

74. The cutter insert, as set forth in claim 40, wherein said plurality of shallow grooves are open-ended toward said conical cutting surface.

75. In a roller cone drill bit having a gage surface contacting a sidewall of a borehole during operations, said gage surface having at least one row of cutter inserts, at least one of said cutter inserts comprising:

a generally cylindrical substrate formed of cemented carbide and having a cutting end, said cutting end having a generally conical cutting surface substantially normal to a longitudinal axis of said cylindrical substrate;

a plurality of shallow grooves formed in said conical cutting surface;

a plurality of strips of polycrystalline diamond having a shape and profile conforming to said shallow grooves, said polycrystalline diamond strips defining cutting surfaces substantially in line with said conical cutting surface defined by said cemented carbide substrate;

said conical cutting surface defined by said cemented carbide substrate and said polycrystalline diamond strips forming a plurality of alternating hard and ultra hard elongated cutting surfaces and a small angle of approach with respect to the sidewall of the borehole; and a sloped surface coupling said conical cutting surface and said cylindrical substrate.

76. In a roller cone drill bit having a gage surface contacting a sidewall of a borehole during operations, said gage surface having at least one row of cutter inserts, at least one of said cutter inserts comprising:

a generally cylindrical substrate formed of cemented carbide and having a cutting end, said cutting end having a generally conical cutting surface substantially normal to a longitudinal axis of said cylindrical substrate;

a plurality of shallow grooves formed in said conical cutting surface;

a plurality of strips of polycrystalline diamond having a shape and profile conforming to said shallow grooves, said polycrystalline diamond strips defining cutting surfaces substantially in line with said conical cutting surface defined by said cemented carbide substrate;

said conical cutting surface defined by said cemented carbide substrate and said polycrystalline diamond strips forming a plurality of alternating hard and ultra hard elongated cutting surfaces and a small angle of approach with respect to the sidewall of the borehole; and wherein said plurality of shallow grooves are shallower near a center of said conical cutting surface than near a periphery edge of said conical cutting surface.

77. A roller cone drill bit having a conical cutter assembly with an improved gage surface cutting element for actively cutting a sidewall of a borehole, comprising:

a generally cylindrical body formed of a hard and wear-resistant material and having a cutting end, said cutting end having a generally conical cutting surface having an angle between 160° and 180°, said conical cutting surface being substantially perpendicular to a longitudinal axis of said cylindrical body;

a plurality of shallow grooves formed in said conical cutting surface;

a plurality of strips of an ultra hard material having a shape and profile conforming to said shallow grooves, said strips defining cutting surfaces substantially in line with said conical cutting surface; and said hard and wear-resistant material and said ultra hard material defining a plurality of alternating hard and ultra hard cutting surfaces and a small angle of approach with respect to the sidewall of the borehole.

* * * * *